US009038343B2

(12) United States Patent
Litaize

(10) Patent No.: US 9,038,343 B2
(45) Date of Patent: May 26, 2015

(54) DEVICE FOR CONNECTING TWO PREFABRICATED CONSTRUCTION ELEMENTS TOGETHER

(75) Inventor: Pierre-Emmanuel Litaize, Thusy (FR)

(73) Assignee: ELMERE (FR)

( * ) Notice: Subject to any disclaimer, the term of this patent is extended or adjusted under 35 U.S.C. 154(b) by 0 days.

(21) Appl. No.: 14/000,881

(22) PCT Filed: Feb. 17, 2012

(86) PCT No.: PCT/FR2012/050341

§ 371 (c)(1),
(2), (4) Date: Aug. 22, 2013

(87) PCT Pub. No.: WO2012/114023

PCT Pub. Date: Aug. 30, 2012

(65) Prior Publication Data

US 2013/0326984 A1 Dec. 12, 2013

(30) Foreign Application Priority Data

Feb. 23, 2011 (FR) ..... 11 51477

(51) Int. Cl.
*E04B 2/00* (2006.01)
*E04B 2/86* (2006.01)
(Continued)

(52) U.S. Cl.
CPC ..... *E04B 2/8647* (2013.01); *E04B 1/043* (2013.01); *E04B 1/41* (2013.01); *E04B 1/4114* (2013.01);
(Continued)

(58) Field of Classification Search
CPC ..... E04C 2/288; E04B 2/8647; E04B 1/043; E04B 1/41; E04B 1/4114; E04B 1/4142; E04B 1/6137
USPC ..... 52/426, 415, 427, 416, 418, 428, 424, 52/425, 429
See application file for complete search history.

(56) References Cited

U.S. PATENT DOCUMENTS 6,151,856 A * 11/2000 Shimonohara ..... 52/426
7,730,688 B2 * 6/2010 Pfeiffer ..... 52/426
(Continued)

FOREIGN PATENT DOCUMENTS

DE 29605301 U1 5/1997
DE 102007015830 A1 10/2008
(Continued)

OTHER PUBLICATIONS

International Search Report for corresponding application PCT/FR2012/050341 filed Feb. 17, 2012; Mail date Jul. 2, 2012.

*Primary Examiner* — Mark Wendell
(74) *Attorney, Agent, or Firm* — Cantor Colburn LLP

(57) ABSTRACT

The invention relates to a prefabricated construction element (1) having a permanent form, such as a longitudinal beam or a panel, consisting of two parallel plates that are formed, through molding and spaced apart from each other, from a hydraulic mixture such as concrete and from a built-in metal reinforcement, said plates being separated by an insulating block and connected together by transverse spacers (not shown), characterized in that said construction element (1) comprises consecutive prepositioning and bottom (6, 7) and/or top (8, 9) linking means, said bottom means (6, 7) consisting of a metal male connector (6) secured to the metal reinforcement of a first element (1) and arranged at the end of the bottom portion of said first element, and a metal female connector (7) secured to said metal reinforcement of a consecutive second element and arranged at the end of the bottom portion of said second element, the relative positioning of the male connector (6) and female connector (7) being such that said connectors can be connected together when the two consecutive elements (1) are assembled.

10 Claims, 6 Drawing Sheets

(51) Int. Cl.

| | |
|---|---|
| ***E04B 1/04*** | (2006.01) |
| ***E04B 1/41*** | (2006.01) |
| ***E04B 1/61*** | (2006.01) |
| ***E04C 2/288*** | (2006.01) |

(52) U.S. Cl.
CPC ..... *E04B 1/4142* (2013.01); *E04B 1/6137* (2013.01); *E04B 2001/4192* (2013.01); *E04C 2/288* (2013.01)

(56) References Cited

U.S. PATENT DOCUMENTS

| | | | | |
|---|---|---|---|---|
| 2002/0116889 | A1* | 8/2002 | Moore, Jr. | 52/426 |
| 2004/0139680 | A1 | 7/2004 | Hambright | |
| 2005/0120659 | A1* | 6/2005 | Nickerson | 52/506.01 |
| 2007/0094973 | A1* | 5/2007 | Zhu | 52/415 |
| 2007/0107341 | A1* | 5/2007 | Zhu | 52/309.12 |
| 2008/0005991 | A1* | 1/2008 | Meilleur et al. | 52/426 |
| 2008/0155925 | A1* | 7/2008 | Pfeiffer | 52/426 |
| 2008/0229692 | A1* | 9/2008 | Crosby et al. | 52/426 |
| 2010/0058700 | A1* | 3/2010 | LeBlang | 52/506.05 |
| 2012/0167503 | A1* | 7/2012 | Suzuki | 52/292 |
| 2012/0186180 | A1* | 7/2012 | LeBlang | 52/426 |
| 2013/0067838 | A1* | 3/2013 | Black et al. | 52/220.7 |
| 2014/0000199 | A1* | 1/2014 | Black | 52/309.4 |

FOREIGN PATENT DOCUMENTS

| | | | |
|---|---|---|---|
| FR | 2332389 | | 11/1975 |
| GB | 2076103 | A | 11/1981 |
| GB | 2113273 | A | 8/1983 |
| WO | 2007143784 | A1 | 12/2007 |

* cited by examiner

DEVICE FOR CONNECTING TWO PREFABRICATED CONSTRUCTION ELEMENTS TOGETHER

TECHNICAL FIELD

The present invention relates to a connecting device for joining together several prefabricated elements with permanent formwork, of the stringer type or panel in the building industry.

BACKGROUND

In a known way, the latter consist of two parallel plates produced by molding, at a distance from each other, from a hydraulic mixture, such as concrete, and of a built-in metal reinforcement, said plates being separated by an insulating block and connected together through transverse spacers.

Thus, these elements are brought onto the building site for immediate use, without any further preparation, if not having to connect them together in a preferentially simple, effective and economical way.

BRIEF SUMMARY

For this purpose the invention relates to a construction element including consecutive pre-positioning and bottom and/or top connecting means, these bottom means being formed by a metal male connector secured to the metal reinforcement of a first element and arranged at the end of the bottom portion on the one hand, and by a metal female connector secured to said metal reinforcement of a second consecutive element and arranged at the end of the bottom portion on the other hand, the relative positionings of the male and female connectors being such so as to allow their connection during the assembling of two consecutive elements.

The present invention also relates to the characteristics which will emerge during the following description, and which will have to be considered individually or according to all their possible technical combinations.

BRIEF DESCRIPTION OF THE DRAWINGS

This description given as a nonlimiting example will improve understanding of how the invention may be carried out with reference to the appended drawings wherein.

DETAILED DESCRIPTION

Figure 4:
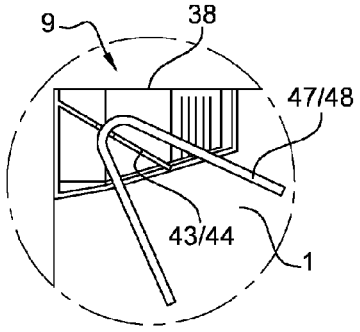
FIGS. 2, 3, 4, 5 schematically illustrate at a larger scale the areas of angles A, B, C, D according to FIG. 1, respectively showing pre-positioning and bottom right-left, i.e. male-female, connecting means, and top right-left connecting means.

The construction element 1 globally designated in the figures comprises of two plates 2 and 3, parallel with each other, made by molding, at a distance from each other, from a hydraulic mixture such as concrete and from a built-in metal reinforcement 4, said plates 2,3 being separated by an insulating block 5 and connected together through transverse spacers (not shown).

According to the invention, it includes consecutive pre-positioning and bottom 6,7 and/or top 8,9 connecting means, these bottom means 6,7 composed of a male metal connector 6 secured to the metal reinforcement 4 of a first element 1 and arranged at the end of its bottom portion on the one hand, and of a female metal connector 7 secured to said metal reinforcement 4 of a second consecutive element 1A and arranged at the end of its bottom portion, the relative positionings of the male 6 and female 7 connectors being such as to allow their connection upon assembling two consecutive elements 1, 1A.

More particularly, the male connector 6 comprises a hook 10 forming an emerging portion from the end of said element 1 and is intended to cooperate positively with a corresponding housing 11 of the female connector 7 of a consecutive element 1A.

According to the present embodiment, the hook 10 of the male connector 6 is formed by a flat part perpendicularly stemming from an added corner angle portion 12 in a bottom corresponding transverse reservation 13, on the end of said element 1.

According to another feature of the invention, the corner angle 12 from which stems the hook 10 of the male connector 6, includes, on its opposite sides, fins 14,15 extending perpendicularly to the latter and parallel to the hook 10, so as to form anchoring points on the plates 2,3 forming said construction element 1 or 1A.

These anchoring fins 14,15 are further provided with holes 16,17 for letting through metal profiles 18,19 for reinforcing the anchoring.

This is a V-shaped concrete reinforcing bar.

Moreover, the housing 11 of the female connector 7 is formed by two sidewalls 20,21 perpendicularly stemming from the vertical face 22*a* of a corner angle portion 22, added in a bottom corresponding transverse reservation 23, at the end of said element 1, said walls 20,21 being closed at their free ends with a third front wall 24 perpendicularly stemming from the other horizontal face 22*b* of the same corner angle 22.

According to another feature of the female connector 7, the sidewalls 20,21 of the housing of the female connector 7 extend with fins 25,26 extending freely apart from each other so as to form a V, so as to allow guidance and to facilitate the introduction of the hook 10 of the male connector 6 into said housing 11.

Like for the male connector 6 described earlier, the corner angle 22 from which stems the housing 11 of the female connector 7, includes, on its opposite faces, fins 27,28 extending perpendicularly to the sidewalls 20,21 of said housing 11, so as to form anchoring points in the plates 2,3 forming said construction element 1 or 1A.

These anchoring fins 27,28 are further provided with holes 29,30 for letting through metal profiles 31,32 for reinforcing the anchoring.

According to another feature of the male connector 6, the horizontal wall 12*a* of the corner angle 12 from which stems the male connector 6, includes a vertical threaded bushing 33, directed downwards, with which a screw 34 cooperates by screwing, thereby allowing adjustment of the level and slope of the element 1 or 1A relatively to the ground.

A locknut 50 blocks the screw 34 after adjustment.

In order to balance the set of two consecutive elements 1,1A during assembly, the bottom horizontal face 12*a* of the corner angle 12 supporting the hook 10 of the male connector 6 extends on either side of said hook 10, with lugs 35,36 extending parallel and able to cooperate upon assembly with the underside of the horizontal face 22*b* of the corner angle 22 of the female connector 7, on either side of its housing 11.

As shown by the whole of the figures, except for FIGS. 4, 5, 8, 14 and 15, an element 1 or 1A includes a male connector 6 at a tip end and a female connector 7 at the other tip end.

Figure 8:
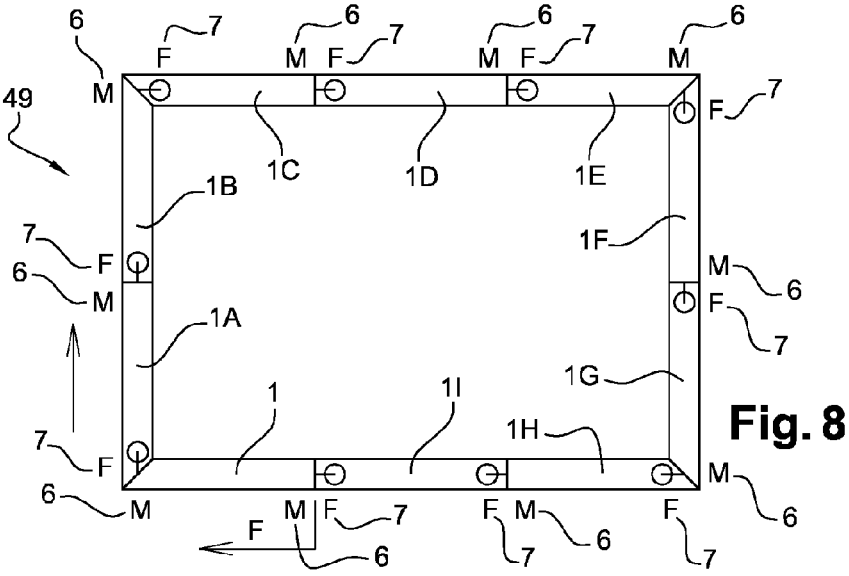
FIG. 8 schematically illustrates, as seen from the top, a construction example of a rectangular base by means of elements according to the invention.
Figure 9:
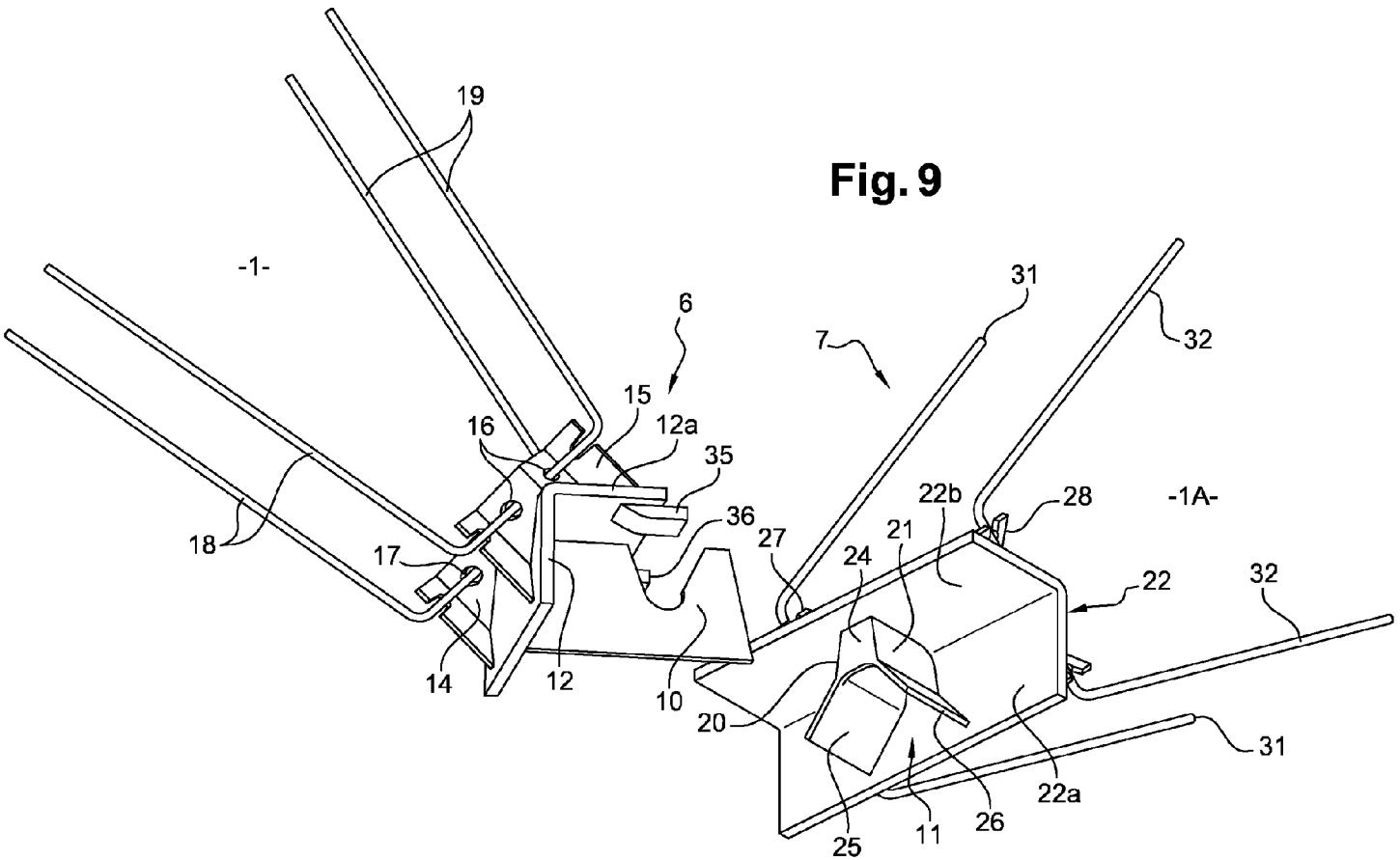
FIG. 9 illustrates in an exploded perspective view, the pre-positioning and bottom male-female connecting means, according to the details A and B of FIG. 1, also corresponding to FIGS. 2 and 3.
Figure 10:
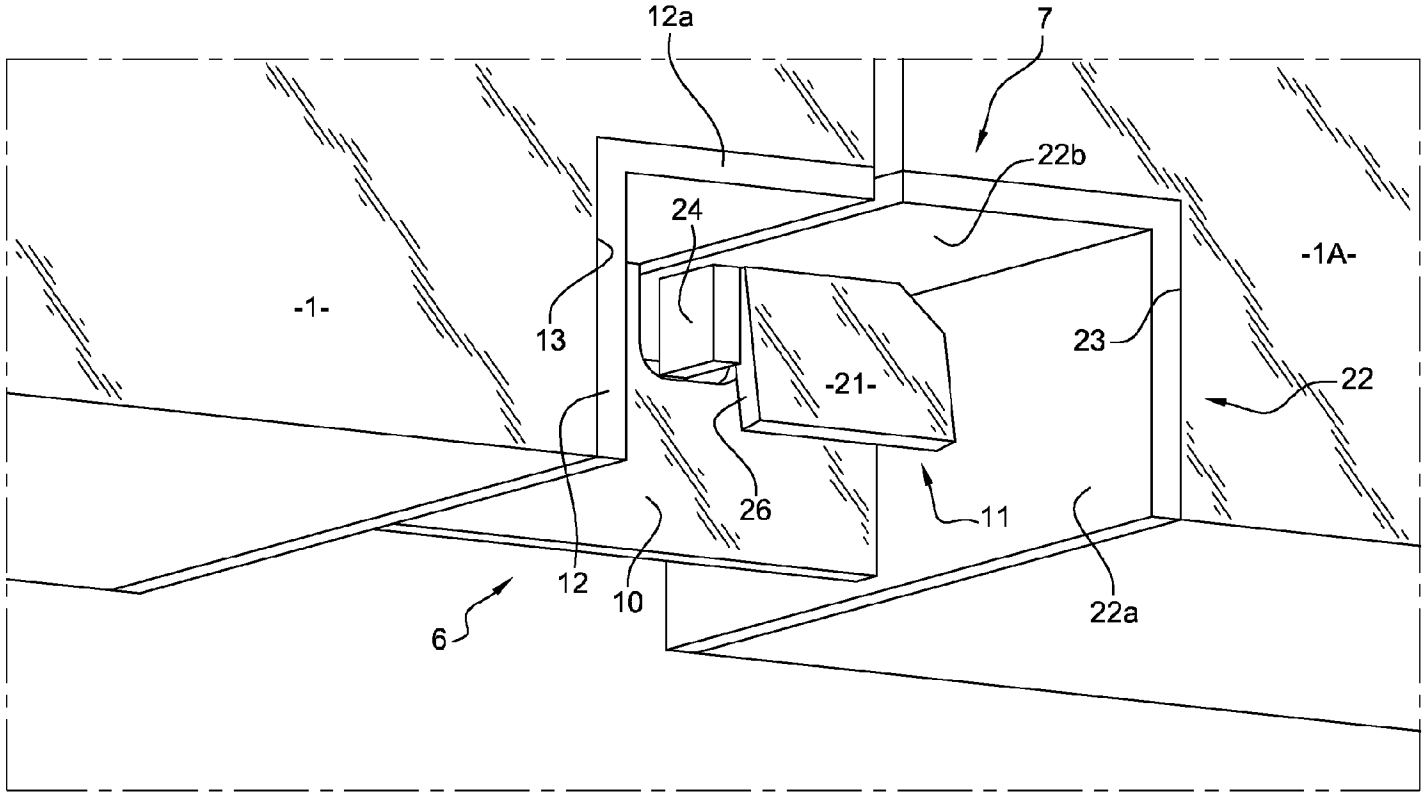
FIG. 10 illustrates as a perspective view, the pre-positioning and bottom male-female connecting means, according to FIG. 9, after integration to their respective construction elements by overmolding and after assembly.
Figure 11:
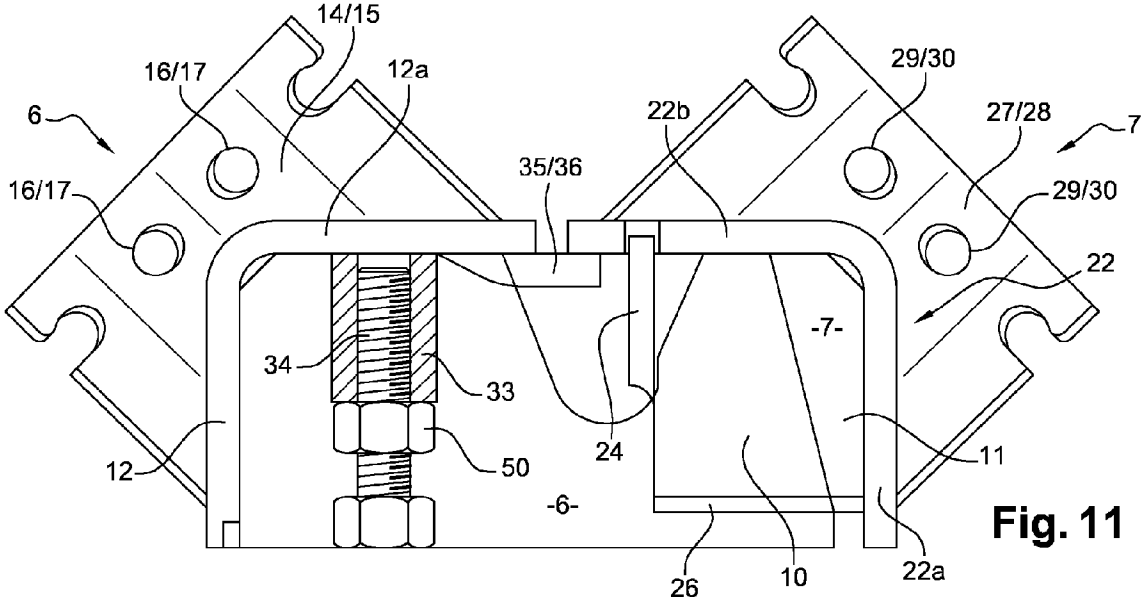
FIG. 11 illustrates as an elevational view, the pre-positioning and bottom male-female connecting means, after assembly according to FIG. 10, but before overmolding in their respective construction elements.
Figure 12:
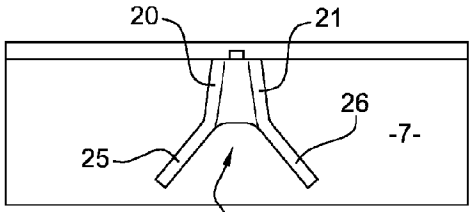
FIG. 12 is an end view, at a reduced scale, of the female portion alone according to FIG. 11.
Figure 13:
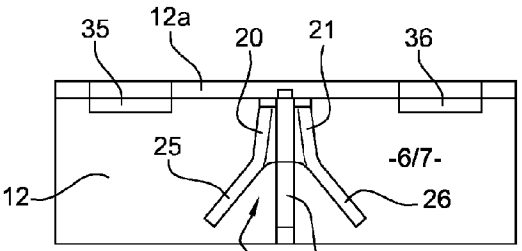
FIG. 13 is an end view, at a reduced scale, of male-female portions after assembly, according to FIG. 11.

But, as illustrated in FIG. 8, this may be an element with bottom female 7—female 7 or male 6—male 6 connectors.

Figure 5:
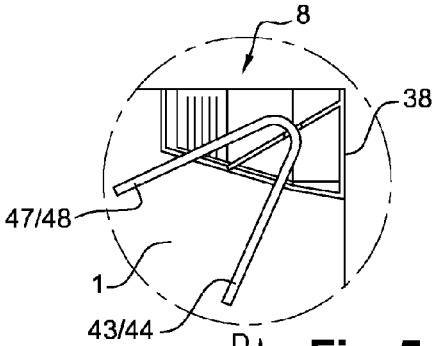
Figure 1:
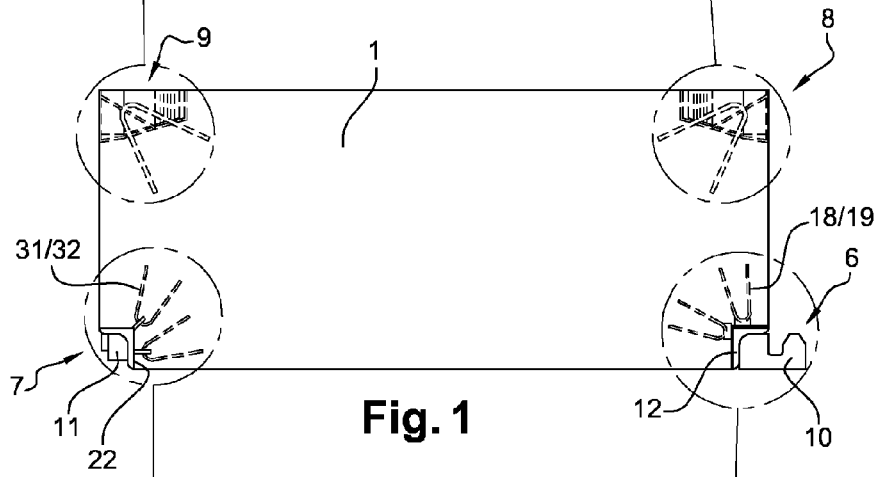
FIG. 1 schematically illustrates an elevational view of a construction element according to the invention.
Figure 3:
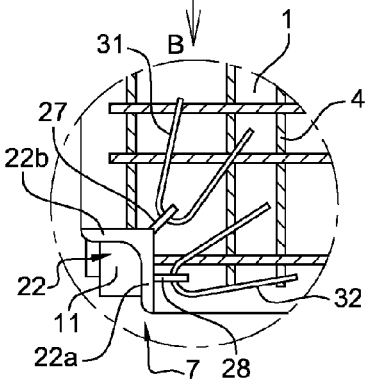
Figure 2:
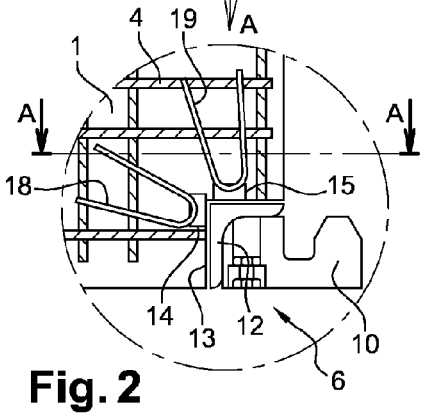
Figure 6:
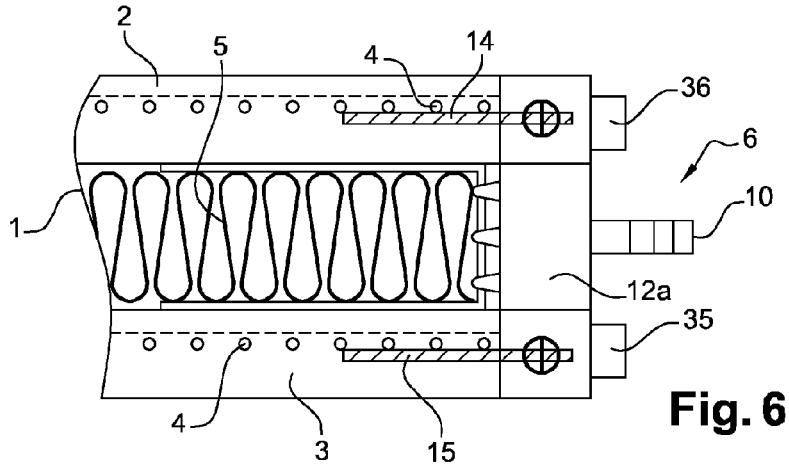
FIG. 6 illustrates as a sectional view AA, the detail A of FIG. 2, as seen from the top.
Figure 7:
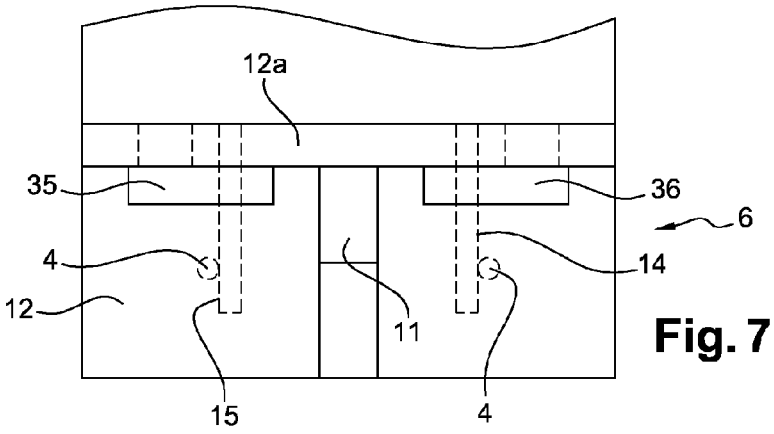
FIG. 7 illustrates an end view according to FIG. 6.
Figure 15:
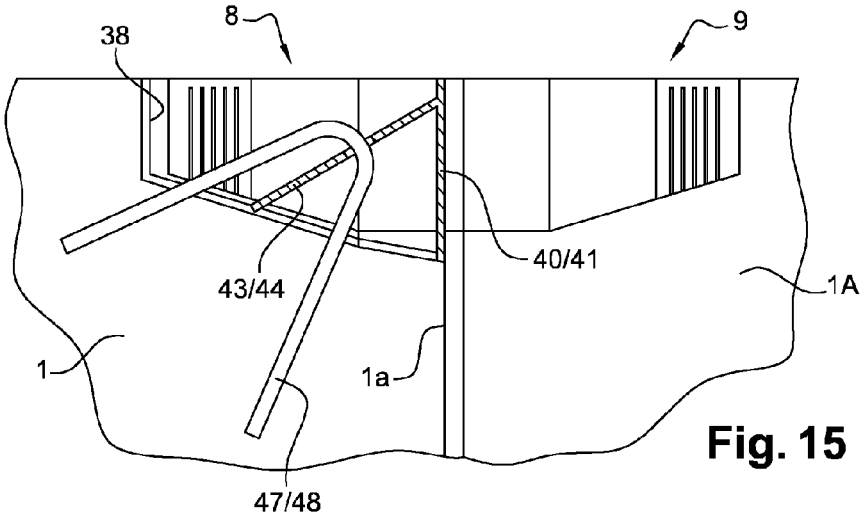
FIG. 15 is an end sectional view according to FIG. 14.
Figure 14:
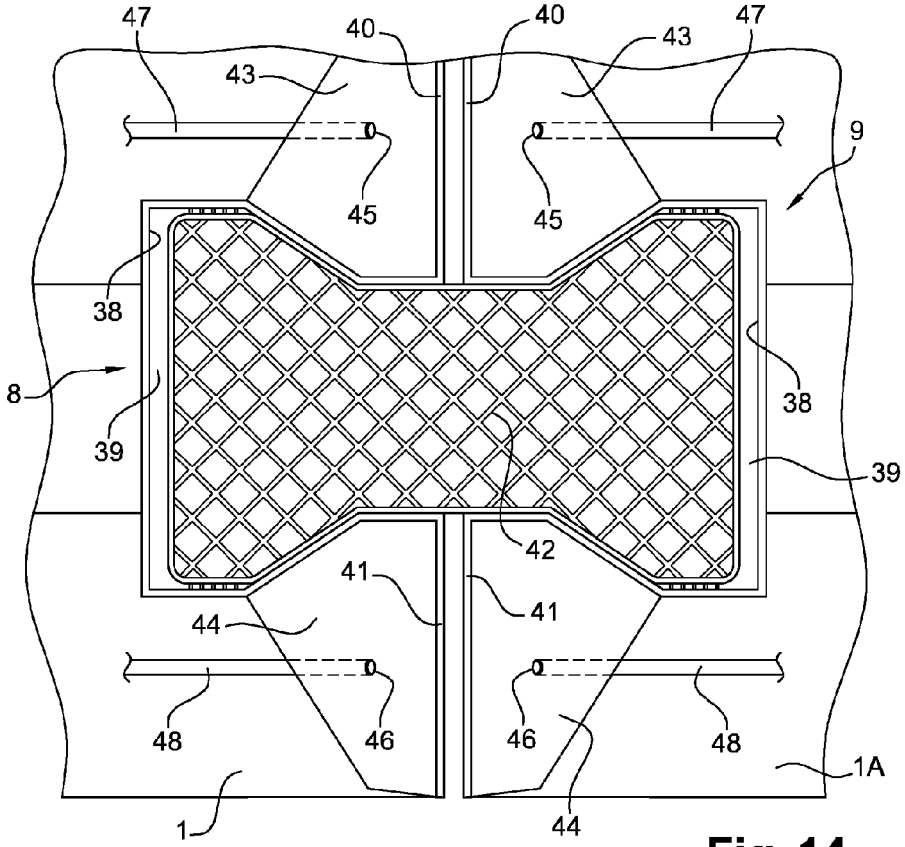
FIG. 14 is a top view of the top right and left connecting means, after having been mounted on two consecutive elements.

According to another feature of the invention, illustrated in FIGS. 1, 4, 5, and still more specifically in FIGS. 14, 15, the construction element 1 or 1A includes at its top portion, connecting means 8,9 formed by a metal female fitting piece 38 with an omega or dovetail shape, the side wings 40,41 of which cooperate with the end 1*a* of the element 1 and the dovetail 38 or omega of which cooperates with a corresponding housing 39 at the end 1*a* of said element 1, said fitting part 38 being reproduced and placed opposite, on a consecutive element 1A to be joined on the one hand, and by a male connecting member 42 forming a double omega or a double dovetail, capable of simultaneously cooperating with both fitting parts 38-38 of two consecutive elements 1,1A.

Like for the male 6 or female 7 connectors described earlier, the fitting parts 38-38 include fins 43,44 forming anchoring points on the plates and are provided with holes 45,46 for letting through metal profiles 47,48 for reinforcing the anchoring.

As an illustrative example represented in FIG. 8, the construction of a base 49 is achieved from construction elements 1,1A,1B,1C,1D,1E,1F,1G,1H,1I.

As seen in this figure, the element 1 is a male <<M>>-male <<M>> element and forms the beginning of the laying. According to the direction of the arrow <<F>>, the sequence of the making is the following:

the element 1A is a female <<F>>-male <<M>> element,
the element 1B is a female <<F>>-male <<M>> element,
the element 1C is a female <<F>>-male <<M>> element,
the element 1D is a female <<F>>-male <<M>> element,
the element 1E is a female <<F>>-male <<M>> element,
the element 1F is a female <<F>>-male <<M>> element,
the element 1G is a female <<F>>-male <<M>> element,
the element 1H is a female <<F>>-male <<M>> element,
the element 1I is a female <<F>>-female <<F>> element, It will be noted that the ends of the angle parts, in this case 1-1A, 1B-1C, 1E-1F, 1G-1H, are beveled at 45°.

Preferentially, the male and female connectors 6,7 are made in galvanized steel.

The invention claimed is:

1. A construction system comprising at least two prefabricated construction elements each having a panel, the panels abutting each other along vertical faces, wherein each prefabricated element includes permanent formwork comprising two parallel plates at a distance from each other, each of the plates being in a solidified hydraulic mixture and including a built-in metal reinforcement, an insulating block separating the two plates, and transverse spacers interconnecting them, said construction system having prepositioning and connecting means to allow connection of two consecutive elements, formed by a male metal connector secured to the metal reinforcement of a first element, and by a female metal connector secured to the metal reinforcement of a second consecutive element, wherein the male connector includes a hook protruding in the direction of the female connector and the female connector forms a housing defined by first and second side walls perpendicularly stemming from a vertical face of a corner angle portion, delimiting a bottom corresponding transverse reservation, at an end of said second element, said first and second side walls being closed at their free ends by a third front wall perpendicularly stemming from a horizontal face of said corner angle, the hook cooperating with said third front wall to assemble the elements, the side walls of the housing of the female connector extending through fins extending away freely from each other to form a V, so as to allow guidance and facilitate the introduction of the hook in said housing.

2. The construction element according to claim 1, wherein the corner angle from which stems the housing of the female connector, includes, on its opposite faces, fins extending perpendicularly to the sidewalls of said housing, so as to form anchoring points in the plates forming said construction element.

3. The construction element according to claim 2, wherein the anchoring fins of the corner angle of the female connector are provided with holes for letting through metal profiles for reinforcement of the anchoring.

4. The construction element according to claim 1, wherein the male connector forms a hook comprising a flat part, perpendicularly stemming from a corner angle portion added in a bottom corresponding transverse reservation, at the end of said element.

5. The construction element according to claim 4, wherein the corner angle from which stems the hook of the male connector, includes, on its opposite faces, fins extending perpendicularly to the side walls of the housing and parallel to the hook, so as to form anchoring points in the plates forming said construction element.

6. The construction element according to claim 5, wherein the anchoring fins of the corner angle of the male connector are provided with holes for letting through metal profiles for reinforcement of the anchoring.

7. The construction element according to claim 4, wherein the horizontal wall of the corner angle from which stems the male connector, includes a vertical threaded bushing, directed downwards, with which a screw cooperates by screwing, thereby allowing adjustment of the level and slope of the element relatively to the ground.

8. The construction element according to claim 4, wherein the bottom horizontal face of the corner angle supporting the hook of the male connector extends on either side of said hook, with lugs extending parallel and capable of cooperating during assembly with the underside of the horizontal face of the corner angle of the female connector, on either side of its housing, so as to balance the whole during assembly.

9. The construction element according to claim 1, further including connecting means at a top portion of the construction element formed by a female metal fitting part, with the shape of an omega or dovetail, extending with side wings cooperating with the end of the element and the dovetail or omega cooperating with a corresponding housing, made at the end of said element, said fitting part being reproduced and placed opposite, on a consecutive element to be joined at a first end and by a male connecting member, forming a double omega or a double dovetail, capable of simultaneously cooperating with both fitting parts of two consecutive elements at a second end.

10. The construction element according to claim 9, wherein the fitting parts include fins forming anchoring points on the plates and are provided with holes for letting through metal profiles for reinforcement of the anchoring.

* * * * *